US005150932A

United States Patent [19]

Conn et al.

[11] Patent Number: 5,150,932

[45] Date of Patent: Sep. 29, 1992

[54] CENTRIFUGE LID SAFETY LOCK

[75] Inventors: Thomas E. Conn, Palo Alto; Benson Kwan, Saratoge, both of Calif.

[73] Assignee: Beckman Instruments, Inc., Fullerton, Calif.

[21] Appl. No.: 640,657

[22] Filed: Jan. 14, 1991

[51] Int. Cl.[5] ..... E05B 3/04

[52] U.S. Cl. ..... 292/202

[58] Field of Search ..... 292/202, 302, 204, 213, 292/59, 209, 341.17, DIG. 7

[56] References Cited

U.S. PATENT DOCUMENTS

| | | | |
|---|---|---|---|
| 779,917 | 1/1905 | Ellingen | 292/213 X |
| 2,211,586 | 8/1940 | Schwary | 292/304 X |

OTHER PUBLICATIONS

Beckman Brochure SB-480K "J6 Series", p. 1, front & back © 1989.

Beckman Brochure SB-610A "AccuSpin", pp. 1,2,4, front & back, Feb. 1986.

Beckman Brochure J221M-IM-3 "Model J2-21M Centrifuge", pp. 3,5,27 & front inside page, Feb. 1986.

*Primary Examiner*—Richard E. Moore

*Attorney, Agent, or Firm*—William H. May; P. R. Harder; Wen Liu

[57] ABSTRACT

A redundant safety lock for securing a centrifuge lid in its closed position. The lock includes a disc having an aperture through which a striker on the lid can be inserted in an unlocked position. The disc is rotated to a locked position such that the striker cannot be withdrawn through the aperture to open the lid. The weight distribution of the disc is substantially symmetrical about its center of rotation. The disc is therefore less susceptible to dislodging form its locked position upon perturbation from shock experienced.

20 Claims, 3 Drawing Sheets

CENTRIFUGE LID SAFETY LOCK

BACKGROUND OF THE INVENTION

1. Field of the Invention

The present invention relates to centrifuges, and more particularly to locking mechanisms for the lid of the centrifuge chamber.

2. Description of Related Art

Centrifuges are used to sediment suspensions in a solution by rotating a rotor containing the solution at high speed thereby creating a large centrifuge field. The rotors are typically made of metal such as aluminum alloys. As the rotor rotates, it builds up a substantial amount of rotational kinetic energy. This energy when released (for example as a result of rotor imbalance, or breakage of the rotor) causes substantial shock to the centrifuge. It has been experienced that the released energy can cause the entire centrifuge unit to rotate on its feet.

The centrifuge chamber in which the rotor rotates is covered with a lid during centrifugation to protect the centrifuge operator from the spinning parts in the chamber. The lid also provides containment should there be material spun off from the rotor. To prevent accidental opening of the lid while the rotor is spinning, locks for the lid have been designed to allow the rotor to spin only after the lid has been fully closed and the lock engaged and to allow the lid to be opened only after the rotor has come to a complete stop. One design of lock makes use of an electromagnetically actuated latch which receives a signal from the centrifuge control which will release the latch to allow for opening of the lid when it has been detected that the rotor has ceased rotation. However, it has been found that the shock experienced and the movement of the centrifuge unit can jostle loose the components of the lock to allow the lid to be opened inadvertently.

SUMMARY OF THE INVENTION

The present invention is directed to a redundant safety lock for securing the centrifuge lid in a closed position. In the described embodiment, the lock comprises a disc having an aperture through which the striker which is attached to the lid is inserted when the lid is closed. The disc can be rotated to a locking position such that the striker cannot be withdrawn through the aperture to allow the lid to open. A latch can also be provided to engage the striker in a locked position. Should the latch be released accidentally as a result of shock experienced, the disc will provide a back-up to keep the lid in the closed position. The disc being substantially symmetrical about its center of rotation is not affected by shock to cause it to move out of its locking position.

DESCRIPTION OF THE ILLUSTRATED EMBODIMENT

The following description is of the best contemplated mode of carrying out the invention. This description is made for the purpose of illustrating the general principles of the invention and should not be taken in a limiting sense. The scope of the invention is best determined by reference to the appended claims.

Figure 1:
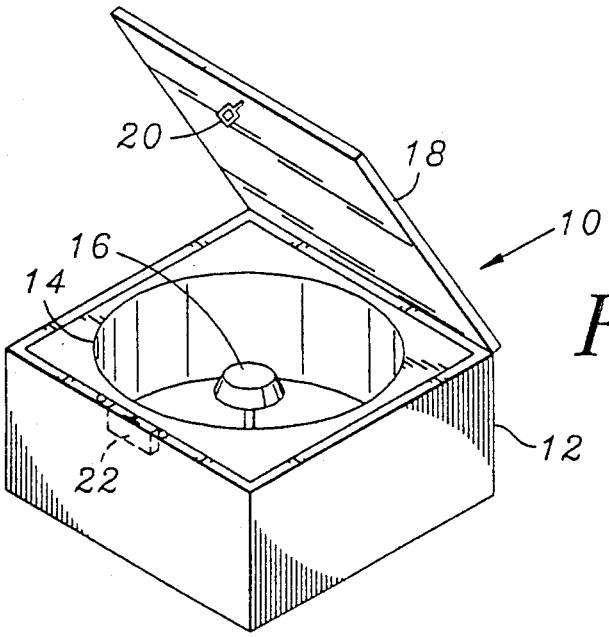
FIG. 1 is a diagram illustrating the general layout of a centrifuge.

Referring to FIG. 1, a simplified drawing of a centrifuge unit 10 is shown. The centrifuge has a housing 12 in which a centrifuge chamber 14 is defined. A rotor 16 is placed in the chamber for carrying out centrifugation. Depending on the application, the rotor can be of the swinging bucket type or fixed angle type. A lid 18 is hinged along one side of the housing 12 to provide closure of the centrifuge chamber 14 during centrifugation. For locking the centrifuge lid 18 in its closed position, a striker 20 is attached to the lid. A locking mechanism 22 is provided on the housing 12 at a position which will cooperate with the striker 20 to lock the lid 18 in the closed position.

Figure 2:
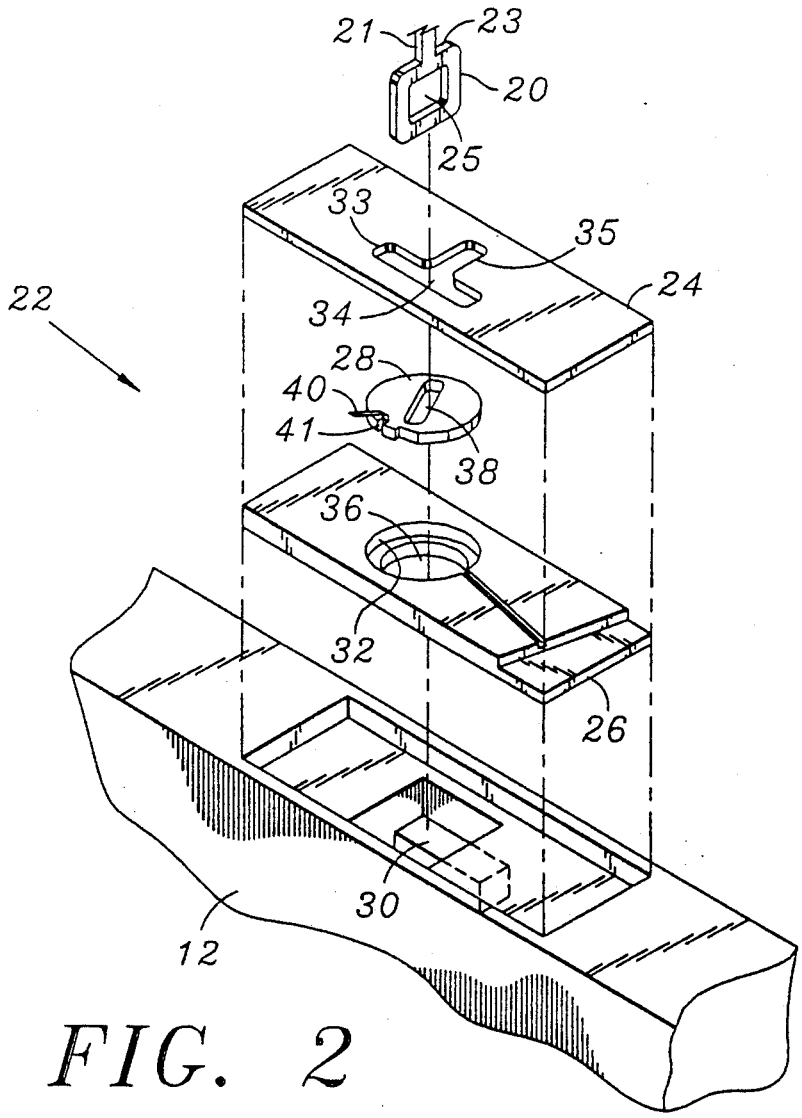
FIG. 2 is an expanded view of the lock mechanism in accordance with one embodiment of the present invention.

The components of the redundant lock mechanism 22 are shown in FIG. 2. The lock mechanism 22 comprises primarily a cover plate 24, a base plate 26, a safety disc 28 and a latch 30. The cover plate 24 has a T-shaped aperture 34 through which the striker, 20 can extend when the lid 18 is closed. The base plate 26 has a circular recess 32 sized to receive the disc 28 and to allow the disc 28 to be rotatable in the recess 32. The base plate has a circular aperture 36 through which the striker 20 can extend. The disc 28 has an aperture 38 sized to allow the striker 20 to extend when the lid 18 is closed. In the assembled configuration (see FIG. 5B), the cover plate 24 is bolted to the base plate 26 and to the frame of the housing 12. The disc 28 is retained in the recess 32 between the cover plate 24 and the base plate 26. The latch 30 is supported in the frame of the housing 12 and positioned to engage the eye 25 of the striker 20 when the lid is closed thereby locking the lid 18 in its closed position. The latch 30 may be electromechanically activated. As will be explained below, the striker 20 has a neck 21 and a shoulder 23 which is below the safety disc 28 when the lid 18 is closed and the disc 28 is set to the locked position. This shoulder 23 and the safety disc 28 cooperates to accomplish the safety back-up feature of the present invention.

Figure 3A:
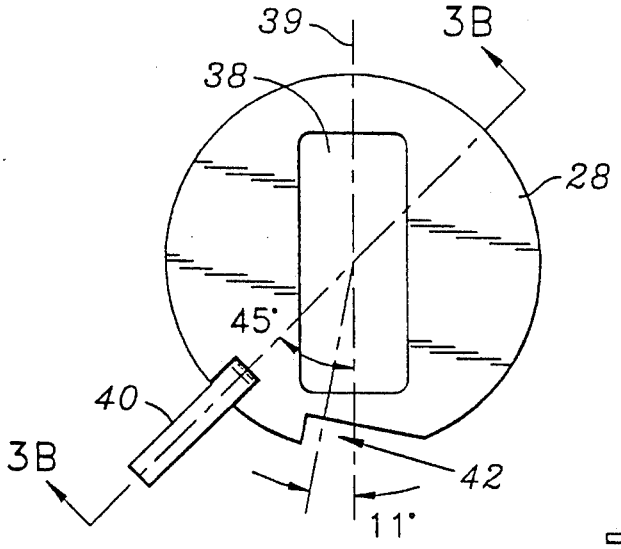
FIG. 3 is the top view of the safety disc.
FIG. 3B is the sectional view of the safety disc taken along line 3B—3B in FIG. 3A.
Figure 3B:
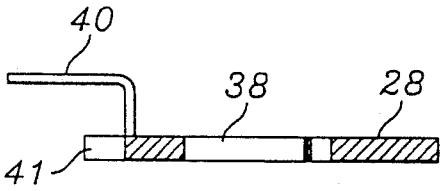

FIGS. 3A and 3B show more clearly the structure of the safety disc 28. The disc 28 is circular having a rectangular aperture 38 in the center of the disc 28. The length of the aperture 38 is slightly larger than the width of the striker 20. The width of the aperture 38 is slightly larger than the thickness of the striker 20. On the circumference of the disc 28 at 45° to the major axis 39 of the rectangular aperture 38, a lever 40 made out of very thin lightweight material is attached to the disc 28. As is shown in FIG. 5B, the lever extends through the portion 33 (FIG. 2) of the T-aperture of the cover plate 24. Adjacent to the lever 40 at the narrower end of the rectangular aperture 38 (11° to the major axis) a detent 42 is formed, the purpose of which will be explained below.

Figure 4A:
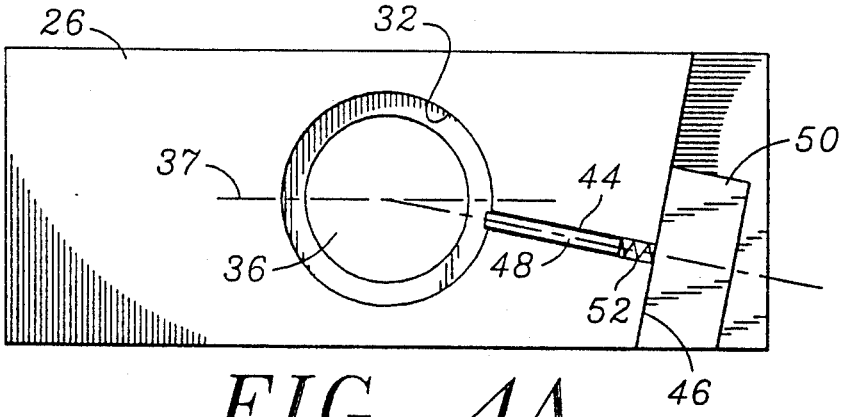
FIG. 4A is the top view of the base plate.
Figure 4B:
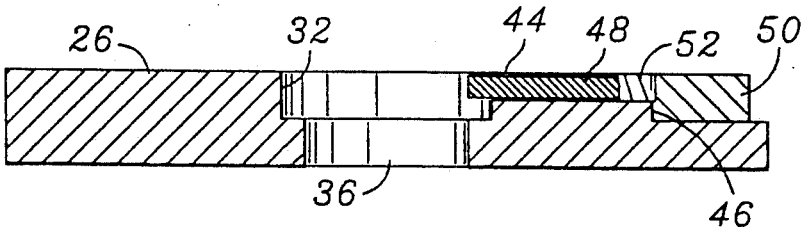
FIG. 4B is the sectional view of the base plate taken along line 4B—4B in FIG. 4A.

FIGS. 4A and B show more clearly the structure of the base plate 26. The circular aperture 36 is aligned with the axis of the disc aperture 38, the aperture 34 on the cover plate and the striker 20. The radius of the circular recess 32 is slightly larger than the radius of the disc 28, and the depth of the recess 32 is slightly larger than the thickness of the disc 28. This will allow clearance for the disc 28 to rotate in the recess 32 when the cover plate 24 and the base plate 26 are assembled on the housing 12 (see FIGS. 5B and 6B) At 11° to the major axis 37 of the rectangular plate 26, a groove 44 is formed which extends between the edge of the recess 32 and a shoulder 46 formed on the base plate near one end. The groove 44 receives a push rod 48 which cooperates with the detent 42 on the disc 28 to actuate a microswitch 50 for indicating the angular position of the disc 28. A spring 52 may be provided to bias the push rod 48 against the edge of the disc 28. The spring may be incorporated in the microswitch to bias the push rod 48.

Figure 5A:
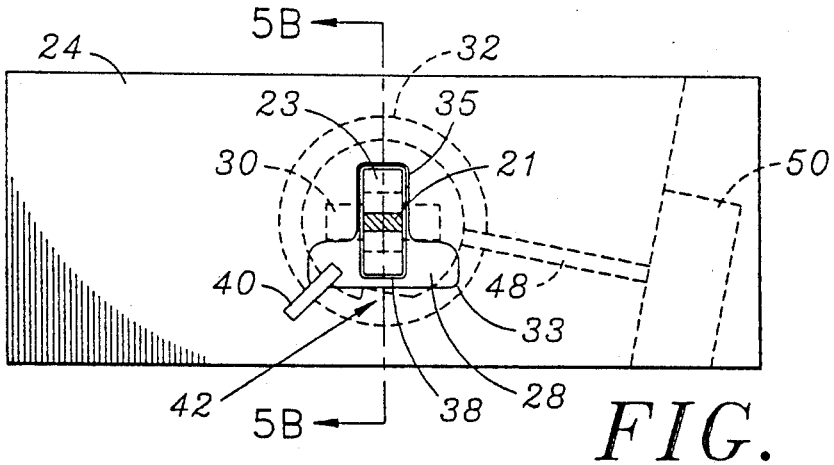
FIG. 5A is the top view (below the lid) illustrating the lock mechanism in its unlocked configuration.
Figure 5B:
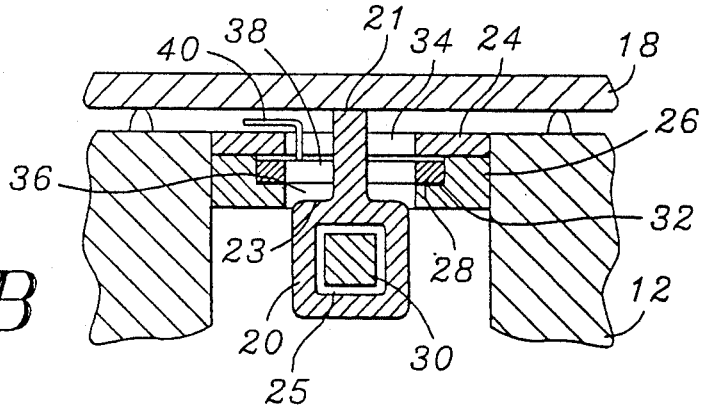
FIG. 5B is the sectional view taken along line 5B—5B in FIG. 5A.

Referring now to FIGS. 5 and 6, the back-up safety feature of the present invention will be described. Prior to closing the lid 18, the disc 28 is rotated clockwise (viewed from the top) with the lever towards its left-most position (the "unlocked" position) as shown in FIG. 5A. In this position, the rectangular aperture 38 of the disc 28 is aligned with the portion 35 of the T-aperture 34 of the cover plate 24. The push rod 48 does not engage the detent 42 on the disc 28. The microswitch 50 is configured to signal to the centrifuge controller (not shown) that the disc 28 is not in the locked position. When the lid 18 is closed, the striker 20 extends through the apertures in the cover plate 24, disc 28 and base plate 26 as shown in FIG. 5A, with the shoulder 23 on the striker 20 just past below the disc 28. The latch 30 is actuated to engage the eye 25 of the striker 20. When the latch 30 has been engaged, a microswitch (not shown) signals to the centrifuge controller that the lid 18 has been closed. However, the centrifuge is not permitted to operate just yet as the back-up safety lock function of the disc 28 has not yet been set.

Figure 6A:
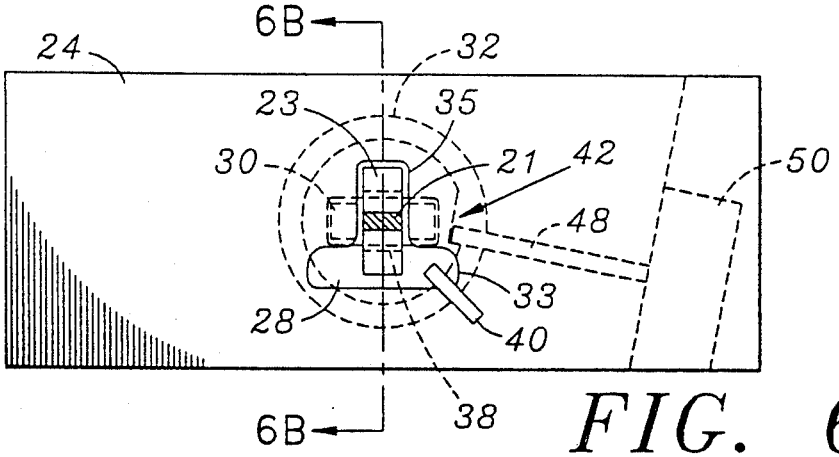
FIG. 6A is the top view (below the lid) illustrating the lock mechanism in its locked configuration.
Figure 6B:
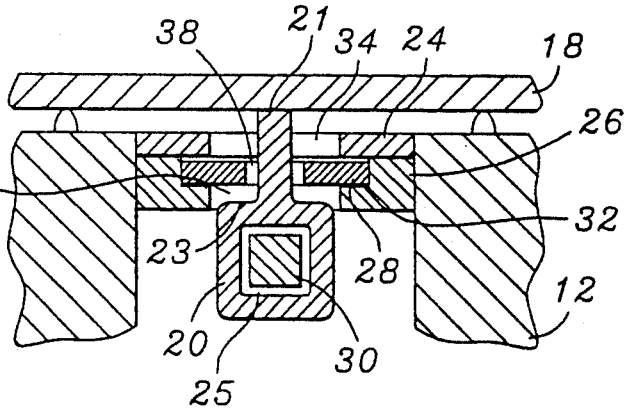
FIG. 6B is the sectional view taken along line 6B—6B in FIG. 6A.

Referring now to FIGS. 6A and 6B, the back-up function of the disc 28 is engaged by rotating the disc 28 90° counterclockwise (viewed from the top) using the lever 40 to its right-most position (the "locked" position"). In this position, the rectangular aperture 38 on the disc 28 is skewed with respect to the portion 35 of the T-aperture 34 and the striker 20. The striker 20 cannot be withdrawn through the aperture 38 as the shoulder 23 of the striker 20 is now trapped below the disc 28. With the disc 28 engaged in this position, in the event that the latch 30 becomes disengaged from the striker 20, the lid 18 cannot be opened. The locked position of the disc 28 is detected by the push rod 48 and microswitch 50 combination. The push rod 48 now engages the detent 42 on the disc 28 to cause the microswitch 50 to signal the centrifuge controller that the disc 28 has been set in the locked position. The controller upon receiving the signals indicating that both the latch 30 and the disc 28 has been set permits the centrifuge to proceed with its programmed operation.

Upon stopping the operation of the centrifuge, the disc 28 is turned to the unlocked position (FIG. 5A) to allow the striker 20 to be disengaged from disc 28. The push rod 48 is pushed out of engagement with the detent 42. The centrifuge control can be set up such that the centrifuge would immediately cease operation in the event that the disc 28 is unlocked prematurely.

The size and material of the lever 40 is chosen such that it will maintain a substantially symmetrical weight distribution about the center of rotation of the disc 28, taking into account the absence of material at the detent 42 and at the root of the lever 40 (see notch 41 in FIGS. 2 and 3B). This makes the center of mass of the disc 28 substantially identical to its center of rotation. Accordingly, when the locking mechanism is jostled, there is substantially no net moment to cause the disc 28 to rotate. For added safety, the locked position of the disc 28 is designed such that the locking direction of the disc 28 is opposite the sense of rotation of the centrifuge housing which may happen due to a rotor mishap. Thus in the example discussed herein, the disc 28 is designed for use on a centrifuge housing which rotates clockwise (viewed from the top) in the event of rotor mishap (for a clockwise rotating rotor). Thus by designing the locked position of the disc as shown in FIG. 5A, the clockwise motion of the centrifuge unit will not loosen the counterclockwise locking position of the disc. For centrifuge units that rotate counterclockwise due to a rotor mishap (for a counterclockwise rotating rotor), the disc 28 and base plate 26 should be the mirror image of FIG. 6A.

From the foregoing discussion, it can be seen that the present invention provides a simple and yet safe lock as backup for the primary latch lock mechanism in a centrifuge. The backup feature involves few additional parts. Existing centrifuges can be conveniently retrofitted with the backup safety lock without substantial modification to the centrifuges. If desired, the disc can be used alone as a primary lock without the need for a latch lock. The symmetrically balanced disc tends to stay in its locked position as it is not affected by perturbations from shock, hence maintaining the integrity of the lock.

While the invention has been described with respect to the preferred embodiments in accordance therewith, it will be apparent to those skilled in the art that various modifications and improvements may be made without departing from the scope and spirit of the invention. For example, a ball and detent combination may be configured for indexed positioning of the disc. The disc may be spring biased towards the locked position so that the centrifuge user has to attend to the disc when closing the centrifuge lid thus serving as a reminder to the user. The spring bias would automatically lock the disc upon complete closure of the lid. The striker and the disc may be provided with cam surfaces to enable the striker to turn the disc from its normally spring biased locked position and to position the disc for insertion of the striker, through the disc aperture, i.e. an automatic locking design. While the invention has been described in reference to a disc, variations of this are contemplated, e.g. a flat cylindrical cup shaped member may be used instead. Accordingly, it is to be understood that the invention is not to be limited by the specific illustrated embodiments, but only by the scope of the appended claims.

We claim:

1. A lock for a lid on a housing of a centrifuge comprising:

a striker attached to the lid, the striker having a narrow portion and a wide depending end;

a member having an aperture sized to receive the wide depending end; the member being rotatably supported on the housing such that the member can be rotated from a first position where the depending end can be slid through the aperture to a second position where the depending end cannot be slid through the aperture, whereby by inserting the striker through the aperture of the member in its first position such that the wide depending end of the striker is past the member and the narrow portion of the striker is within the aperture of the member, and turning the member to the second position, the striker is restricted from being withdrawn through the aperture thereby locking the lid.

2. A lock as in claim 1 wherein the member has substantially symmetrical weight distribution about its center of rotation such that its center of mass is substantially identical to its center of rotation.

3. A lock as in claim 2 wherein the member comprises a flat circular disc.

4. A lock as in claim 1 further comprising means for indicating the rotational position of the member.

5. A lock as in claim 4 wherein the indicating means comprises a switch electrically coupled to a controller of the centrifuge.

6. A lock as in claim 5 wherein the indicating means signals the controller when the second position has been attained or breached.

7. A lock as in claim 1 wherein rotation of the member from the first position to the second position is in a direction opposite to the sense of rotation of the housing in the event of a rotor mishap.

8. A lock for a lid on a housing of a centrifuge comprising a striker and a rotary locking member combination interfacing between the lid and the housing, wherein:

the striker has a narrow portion and a wide end; and the member has an aperture sized to receive the wide end, the member being rotatably supported such that the member can be rotated from a first position where the wide end can be slid through the aperture to a second position where the wide end cannot be slid through the aperture, whereby by inserting the striker through the aperture of the member in its first position such that the wide end of the striker is past the member and the narrow portion of the striker is within the aperture of the member, and turning the member to the second position, the striker is restricted from being withdrawn through the aperture thereby locking the lid.

9. A lock as in claim 8 wherein the member has substantially symmetrical weight distribution about its center of rotation such that its center of mass is substantially identical to its center of rotation.

10. A lock as in claim 9 wherein the member comprises a flat circular disc.

11. A lock as in claim 8 further comprising means for indicating the rotation position of the member.

12. A lock as in claim 11 wherein the indicating means comprises a switch electrically coupled to a controller of the centrifuge.

13. A lock as in claim 12 wherein the indicating means signals the controller when the second position has been attained or breached.

14. A lock as in claim 8 wherein rotation of the member from the first position to the second position is in a direction opposite to the sense of rotation of the housing in the event of a rotor mishap.

15. A device for locking a lid on a housing of a centrifuge which supports a rotor for rotation in a first direction, the device comprising a striker and a rotary locking member combination interfacing between the lid and the housing, wherein:

the striker has a narrow portion and a wide end; and the member has an aperture sized to receive the wide end, the member being rotatably supported such that the member can be rotated from a first position where the wide end can be slid through the aperture, in a second direction opposite to the first direction to a second position where the wide end cannot be slid through the aperture, whereby by inserting the striker through the aperture of the member in its first position such that the wide end of the striker is past the member and the narrow portion of the striker is within the aperture of the member, and turning the member to the second position, the striker is restricted from being withdrawn through the aperture thereby locking the lid.

16. A lock as in claim 15 wherein the member has substantially symmetrical weight distribution about its center of rotation such that its center of mass is substantially identical to its center of rotation.

17. A lock as in claim 16 wherein the member comprises a flat circular disc.

18. A lock as in claim 15 further comprising means for indicating the rotational position of the member.

19. A lock as in claim 18 wherein the indicating means comprises a switch electrically coupled to a controller of the centrifuge.

20. A lock as in claim 19 wherein the indicating means signals of the controller when the second position has been attained or breached.

* * * * *